US006295942B1

(12) United States Patent
Leonardson

(10) Patent No.: US 6,295,942 B1
(45) Date of Patent: Oct. 2, 2001

(54) DOCKING FIXTURE

(76) Inventor: Tracee A. Leonardson, 1801 E. 29th St., Ashtabula, OH (US) 44004

( * ) Notice: Subject to any disclaimer, the term of this patent is extended or adjusted under 35 U.S.C. 154(b) by 0 days.

(21) Appl. No.: 09/818,067

(22) Filed: Mar. 26, 2001

(51) Int. Cl.[7] ..... B63B 21/04
(52) U.S. Cl. ..... 114/218
(58) Field of Search ..... 114/218, 230.1, 114/293; 119/738, 769, 771, 786; 248/495; 411/551–553; 70/2, 18, 59, 60

(56) References Cited

U.S. PATENT DOCUMENTS 4,297,963 * 11/1981 Beacom ..... 114/230
5,690,042 * 11/1997 Bentley ..... 114/230
5,941,191 * 8/1999 Dysarz ..... 114/218

* cited by examiner

*Primary Examiner*—Ed Swinehart
(74) *Attorney, Agent, or Firm*—Gene Scott-Patent Law & Venture Group

(57) ABSTRACT

A fixture for securing a water craft to a dock includes a linear rigid shaft, terminating at one end with a ring. The shaft is integral with an exterior surface of the ring which provides a first internal machine thread. A disk shaped element provides a first external machine thread for threadedly engaging the first machine thread of the ring. The disk shaped element further provides a pair of opposing arms, extending outwardly from its opposing sides. A pair of spaced apart washer disks are threadedly engaged with the shaft such that rotation in a first rotational sense drives the washer disks together for gripping a dock, and rotation in an opposite sense drives the washer disks apart for loosening the invention from its mount.

3 Claims, 5 Drawing Sheets

DOCKING FIXTURE

BACKGROUND OF THE INVENTION

1. Field of the Invention

This invention relates generally to boat tie-up such as are established at the edges of docks, wharfs, and such, and more particularly to a tie-up capable of being quickly secured.

2. Description of Related Art

The prior art teaches the use of dock cleats and tying pins, tie-up and a wide range of devices for receiving a boat line, but does not teach a docking tie-up capable of being tightened by rotation of its primary shaft nor of providing for a replaceable insert. The present invention fulfills these needs and provides further related advantages as described in the following summary.

SUMMARY OF THE INVENTION

The present invention teaches certain benefits in construction and use which give rise to the objectives described below.

The instant invention may be used for a wide range of applications such as for tying up cattle and horses and other livestock. In various forms it may be also used in the mechanics or woodworker's shop for many applications limited only to the imagination of these that have a need. The insert of the present invention may be configured as a support, an attachment, a holder, a gripper and many other things. As a docking fixture for securing a water craft to a dock it includes a linear rigid shaft, terminating at one end with a ring. The shaft is integral with an exterior surface of the ring which provides a first internal machine thread. A disk shaped element provides a first external machine thread for threadedly engaging the first machine thread of the ring. The disk shaped element further provides a pair of opposing arms, extending outwardly from its opposing sides. A pair of spaced apart washer disks are threadedly engaged with the shaft such that rotation in a first rotational sense drives the washer disks together for gripping a dock, and rotation in an opposite sense drives the washer disks apart for loosening the invention from its mount.

A primary objective of the present invention is to provide an apparatus and method of use of such apparatus that provides advantages not taught by the prior art.

Another objective is to provide such an invention capable of being tightened in its mount by turning a single shaft.

A further objective is to provide such an invention capable of being assembled using a washer of its construction as a wrench.

A still further objective is to provide such an invention capable of accepting a range of different insert for a variety of purposes.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

Figure 1:
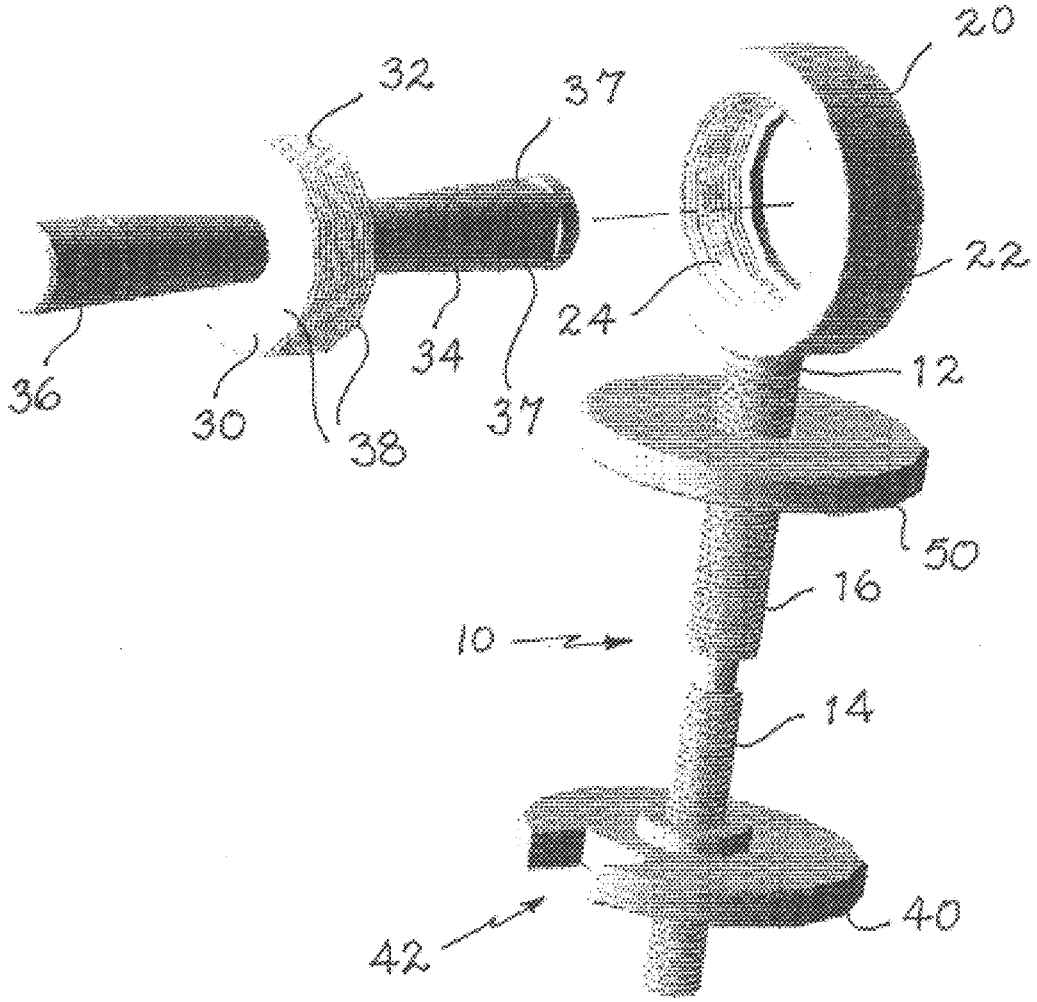
FIG. 1 is a perspective view of the preferred embodiment of the invention shown as partially disassembled.
Figure 2:
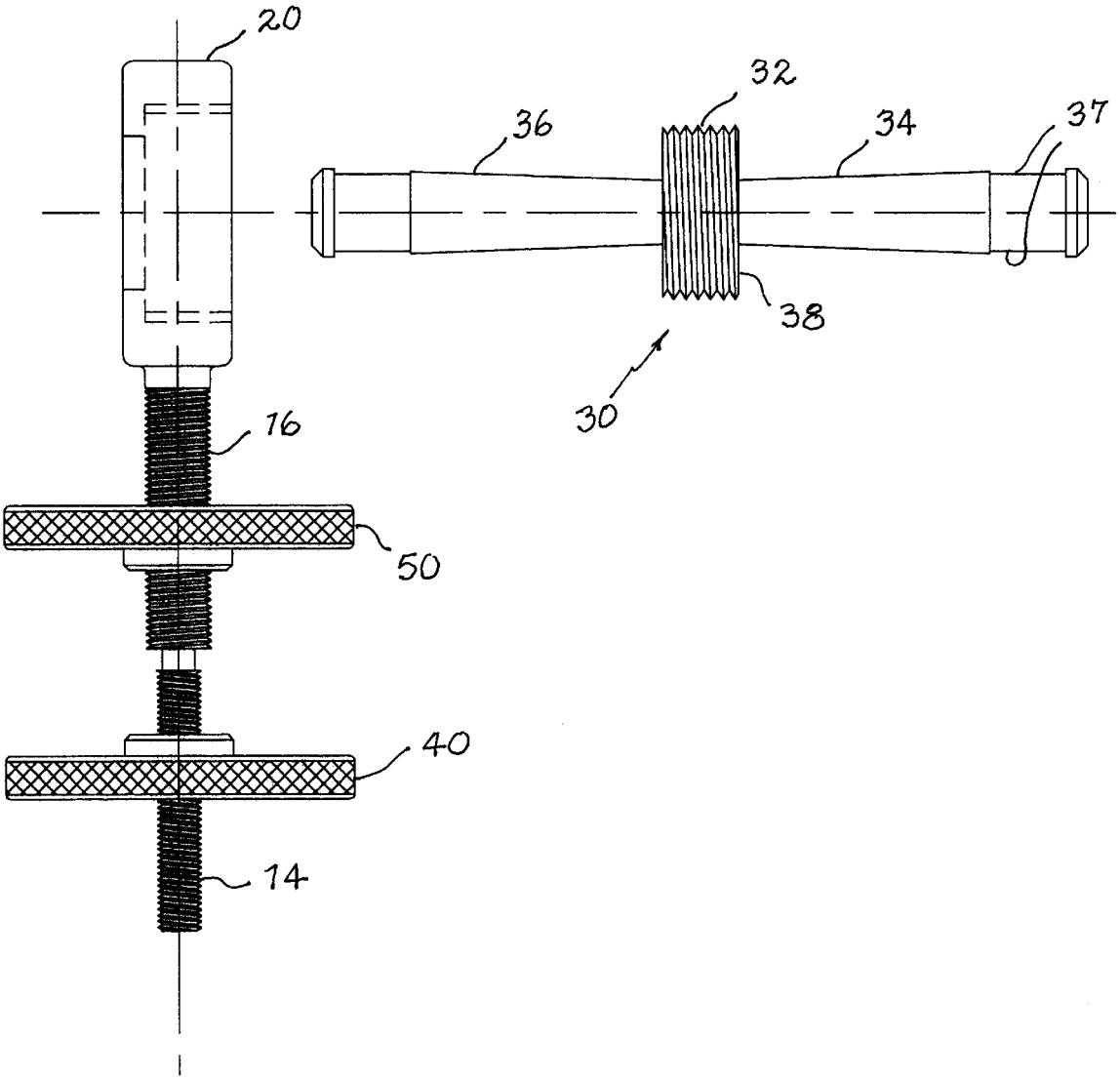
FIGS. 2 and 3 are side elevational views thereof shown disassembled and assembled respectively.
Figure 3:
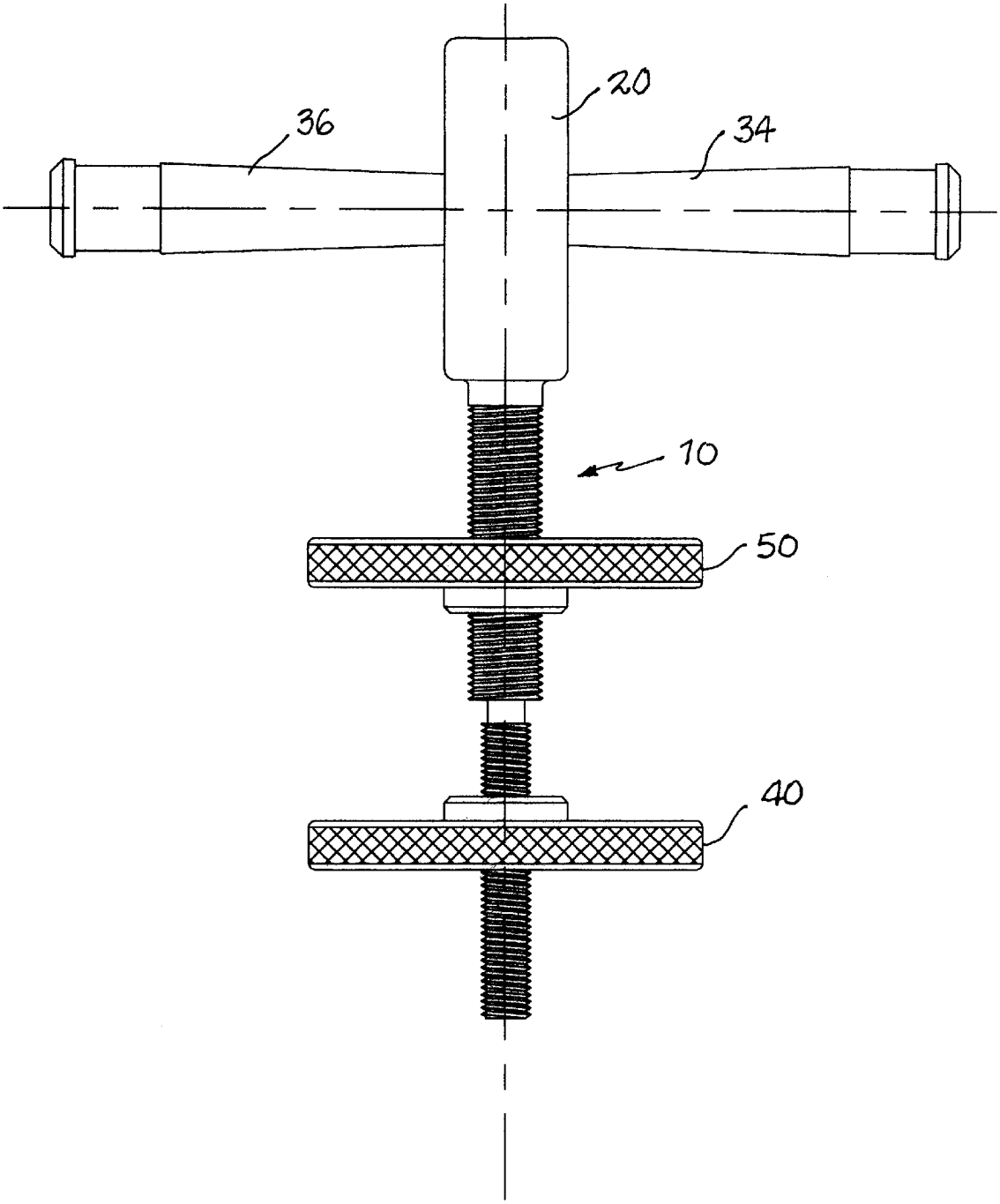
Figure 4:
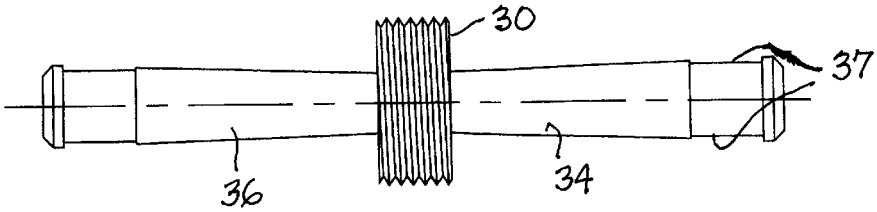
FIG. 4 is a side view of an insert thereof.
Figure 5A:
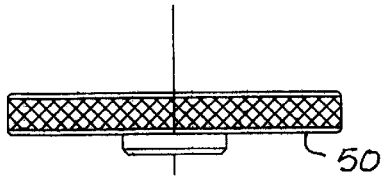
FIG. 5A is side view of a first disk thereof.
Figure 5B:
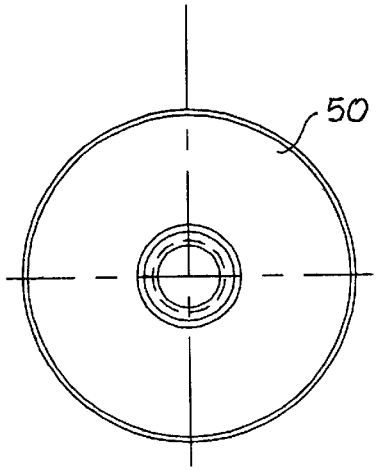
FIG. 5B is a plan view of the first disk.
Figure 7:
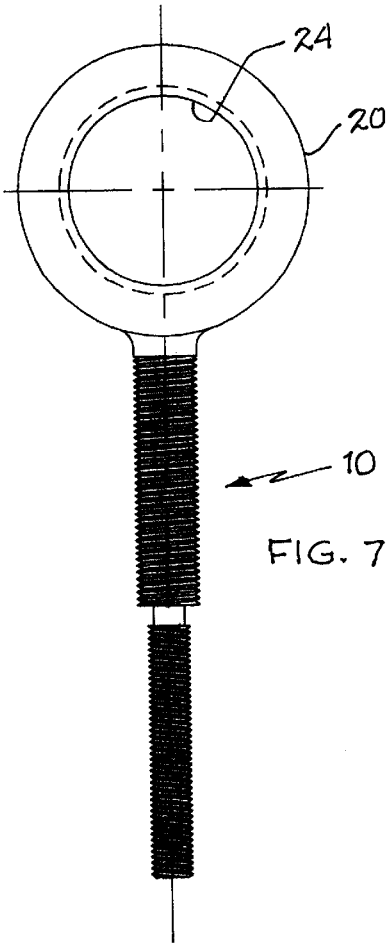
FIG. 7 is a front elevational view of a shaft with ring thereof.
Figure 6A:
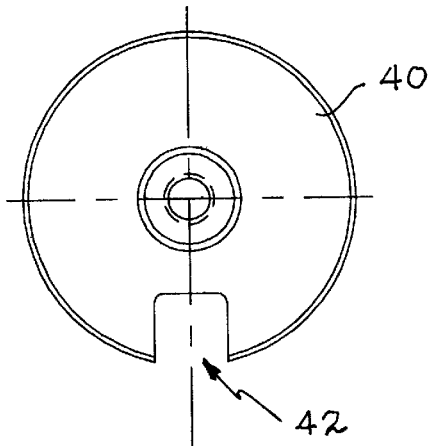
FIG. 6A is a plan view of a second disk thereof.
Figure 6B:
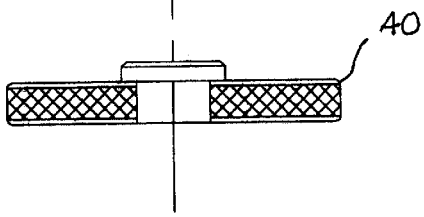
FIG. 6B is a side view of the second disk.
Figure 8:
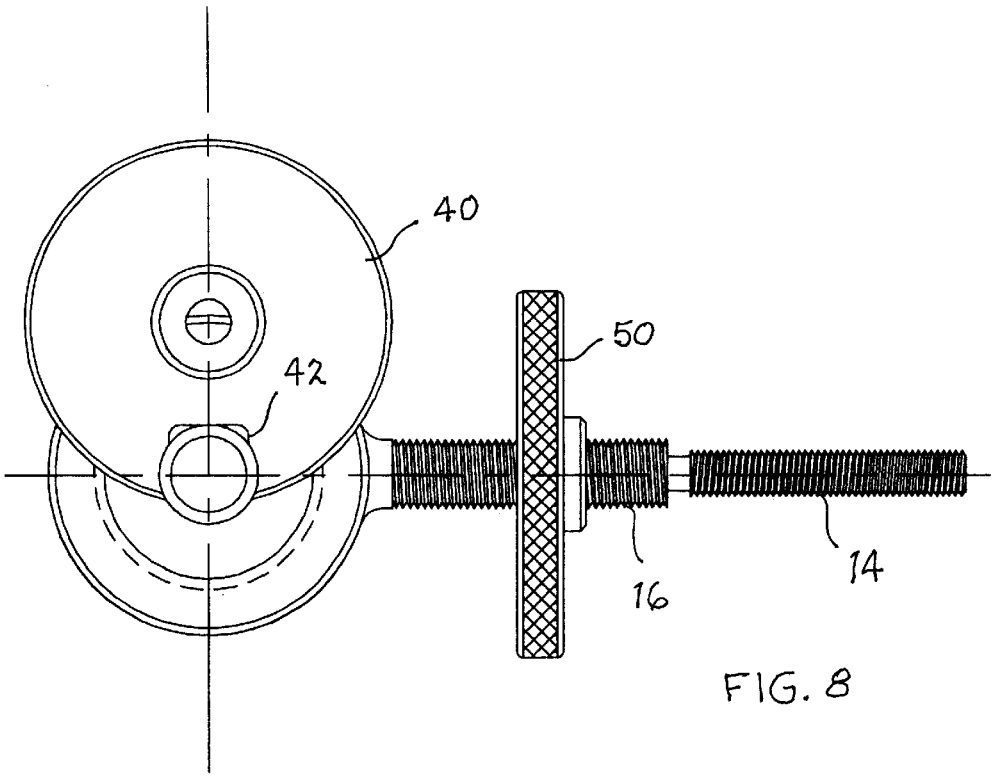
FIG. 8 is a front elevational view of the shaft with ring showing the method of attachment of a disk for rotation of the insert within the ring.
Figure 9:
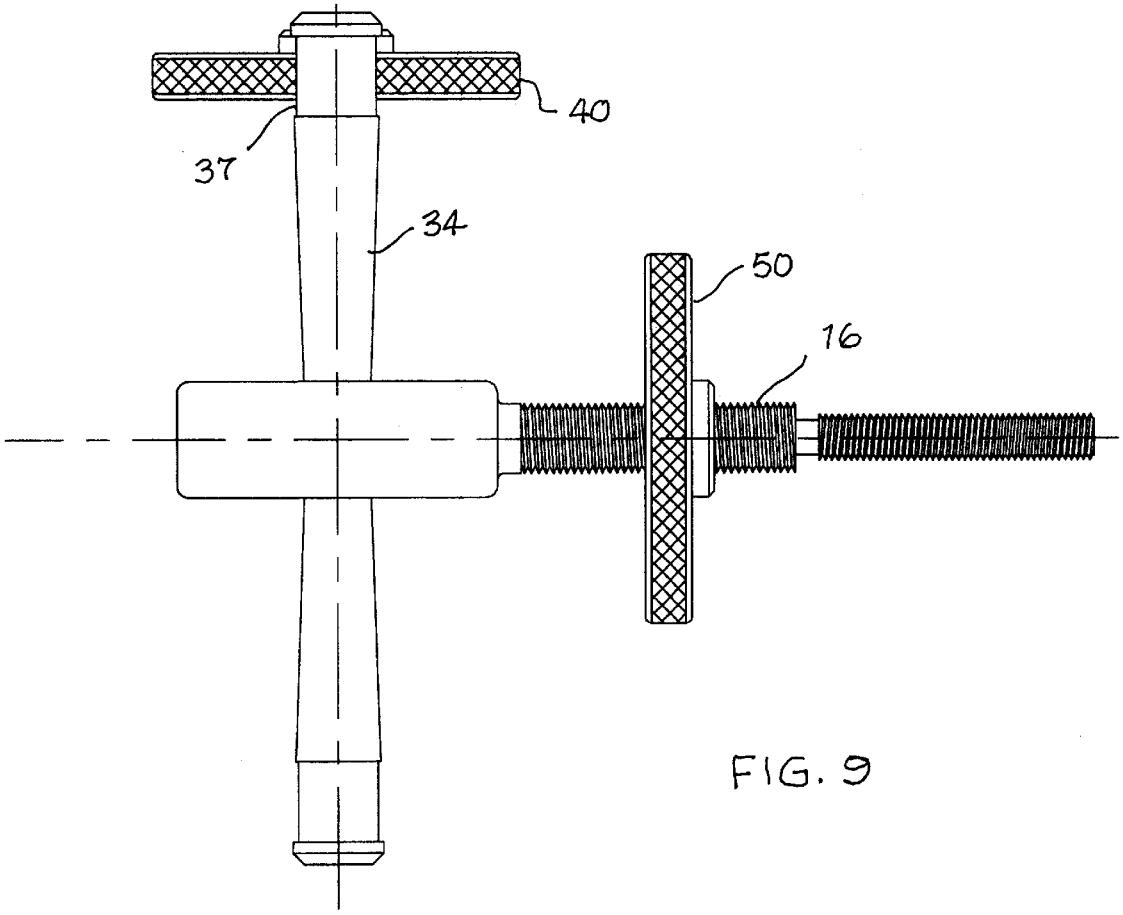
FIG. 9 is a side elevational view of the apparatus as shown in FIG. 8.

The above described drawing figures illustrate the invention in at least one of its preferred embodiments, which is further defined in detail in the following description.

The invention is a docking fixture apparatus having a primary use of securing a water craft to a dock. The invention comprises a linear rigid shaft 10, terminating at one end 12 thereof, with a ring 20. The shaft 10 is integral with an exterior surface 22 of the ring 20 which provides a first internal machine thread 24. A disk shaped element 30 provides a first external machine thread 32 for threadedly engaging the first machine thread 24 of the ring 20. The disk shaped element 30 further provides a pair of opposing arms 34, 36 extending outwardly from opposing sides 38 of the disk shaped element 30. A pair of spaced apart washer disks 40, 50 are threadedly engaged with the shaft 10 such that rotation of the shaft 10 in a first rotational sense drives the washer disks 40, 50 together, and rotation of the shaft 10 in a rotational sense opposite to the first rotational sense drives the washer disks 40, 50 apart.

An important aspect of the invention is that the shaft 10 provides a pair of second external machine threaded portions 14, 16 of differing diameters, one having a right-handed thread and the other a left-handed, such that one of the pairs of washer disks 50 is enabled for passing one of the second external machine threaded portions 14 without interference, while engaging the other of the external machine threaded portions 16.

Another important aspect of the invention is that at least one 34 of the opposing arms 34, 36 provides a pair of opposing flats 37 and at least one of the pair of washer disks 40, 50 provides a notch 42 engageable with the opposing flats 37 for engaging the washer disk 40 with the arm 34.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A fixture apparatus for securing a water craft which comprises: a linear rigid shaft, terminating at one end thereof, with a ring, the shaft integral with an exterior surface of the ring, the ring providing a first internal machine thread therein; a disk shaped element providing a first external machine thread for threadedly engaging the first machine thread of the ring, the disk shaped element further providing a pair of opposing arms extending outwardly from opposing side thereof; a pair of spaced apart washer disks threadedly engaged with the shaft such that rotation of the shaft in a first rotational sense drives the washer disks together, and rotation of the shaft in a rotational sense opposite to the first rotational sense drives the washer disks apart.

2. The apparatus of claim 1 wherein the shaft provides a pair of second external machine threaded portions of differing diameters such that the one of the pair of washer disks is enabled for passing one of the second external machine threaded portions while engaging the other of the external machine threaded portions.

3. The apparatus of claim 1 wherein at least one of the opposing arms provides a pair of opposing flats and at least one of the pair of washer disks provides a notch engageable with the opposing flats for engaging the washer disk with the arm.

* * * * *